US006474101B1

(12) United States Patent
Quine et al.

(10) Patent No.: US 6,474,101 B1
(45) Date of Patent: Nov. 5, 2002

(54) NATURAL GAS HANDLING SYSTEM

(75) Inventors: Thomas G. Quine, Methuen, MA (US); James M. Hunt, Salem, NH (US); James M. Smilikis, Georgetown, MA (US)

(73) Assignee: Northstar Industries, Inc., Methuen, MA (US)

( * ) Notice: Subject to any disclaimer, the term of this patent is extended or adjusted under 35 U.S.C. 154(b) by 0 days.

(21) Appl. No.: 09/860,476

(22) Filed: May 21, 2001

(51) Int. Cl.[7] ..... F25J 1/00
(52) U.S. Cl. ..... 62/657; 62/50.2
(58) Field of Search ..... 62/7, 48.1, 50.1, 62/50.2, 657

(56) References Cited

U.S. PATENT DOCUMENTS 3,232,725 A * 2/1966 Secord et al. ..... 62/50.1
4,987,932 A * 1/1991 Pierson ..... 62/50.1
5,127,230 A * 7/1992 Neeser et al. ..... 62/50.1
5,373,700 A * 12/1994 McIntosh ..... 62/50.2
5,520,000 A * 5/1996 Pevzner ..... 62/50.1
6,058,713 A * 5/2000 Bowen et al. ..... 62/7

* cited by examiner

*Primary Examiner*—Ronald Capossela
(74) *Attorney, Agent, or Firm*—Shinjyu Global IP Counselors, LLP

(57) ABSTRACT

A natural gas handling system is provided having a new modular design to provide clean and accessible fuel for remote compressed natural gas. The natural gas handling system has a storage unit with a heated exchanger that converts the liquefied natural gas to compressed natural gas having a predetermined pressure of approximately 5000 psig without the use of pumps or compressors. The LNG/CNG storage unit has an outlet for providing warmed natural gas at approximately psig. If desired, refrigeration can be supplied from the −260° F. LNG during the vaporization process. The LNG/CNG storage unit also has a second outlet with a pressure regulator for providing warmed compressed natural gas at approximately 60 psig.

20 Claims, 1 Drawing Sheet

LNG TRANSPORT
12
10

LIQUID OUT
41b
43b
VAPOR
41
43
44
43a
40
49a
30
50
41a
LDI
42'
ASME VESSEL
46
48
49a
42
53
50a
45
PRESSURE
BUILD COIL
CONTROL
UNIT
47
49
16
42a
53a
FUEL
CELL
42b
18
OTHER
USES
62d
62c
66
61a
SET @
20PSIG
62b
31
32
CONTROL
UNIT
61b
65
PT
1
62a
63b
METER
LDI
62
20
68
64
60
63
63a
SET @
5000 PSIG
63c
14
64a

NATURAL GAS HANDLING SYSTEM

BACKGROUND OF THE INVENTION

1. Field of the Invention

This invention generally relates to handling natural gas at a natural gas facility. More specifically, the present invention relates to a natural gas handling system that stores liquefied natural gas (LNG) and converts liquefied natural gas (LNG) to warm high pressure and medium pressure compressed natural gas (CNG) without the use of pumps or compressors. In addition, the present invention can provide a source of cold in that the heat of vaporization of LNG represents 220 Btu's/pound of energy and the sensible heat of the vapor represents approximately 0.5 Btu's/pound degrees Fahrenheit.

2. Background Information

Deregulation of the natural gas industry has created the need for complete system solutions relating to the handling of natural gas, especially the handling of liquefied natural gas (LNG) and compressed natural gas (CNG). One of the least-polluting fuels is natural gas. Moreover, the cost of natural gas is very competitive when compared to other fuels, which are currently available on-the market. Thus, natural gas is an environmentally friendly and cost effective alternative to other fuels which is being given a high priority by government and industry due to it's easy access and long term availability. Natural gas is commonly used in two different forms, i.e., compressed natural gas (CNG) and liquefied natural gas (LNG).

The use of compressed natural gas (CNG) as a fuel for motor vehicles has been known for many years, and is in use in many areas of the world. One obstacle to the use of compressed natural gas vehicles is the cost to process clean CNG to a re-fueling station from the nearest natural gas pipeline. In the past, the conventional manner for handling the natural gas is to filter and compress natural gas from the pipeline and then transport the natural gas to the re-fueling stations. However, transportation of the natural gas can be expensive, since natural gas often contains impurities or stations need to be located in areas with no pipelines.

It has also been demonstrated that natural gas can be liquefied and stored in refrigerated vessels for transportation, as described in U.S. Pat. No. 3,232,725. The method requires refrigeration equipment and insulation to hold the gas in a sub-freezing temperature during transportation.

The use of LNG has become very common in the Northeast area of the United States. In fact, the process is not new. The liquefaction of natural gas dates back to the early 1900's. LNG has been used as a vehicle fuel since the mid 1960 s. LNG is produced in a liquefaction plant where natural gas is liquefied, stored in an insulated storage tank, and, when needed, is pumped out of the tank as a liquid, heated in a vaporizer or re-gasifier and delivered to the pipeline or distribution system at a compatible temperature and pressure. The technology came out of NASA's space program. There are approximately 100 LNG facilities in the United States that can serve as hubs for many satellite facilities such as the present invention.

When natural gas is cooled to a temperature of approximately −260° F. at atmospheric pressure, it condenses to a liquid (LNG). One cubic foot of liquid is equal to 618 cubic feet of natural gas found at a stove-top burner. Application of heat to the liquid natural gas at its latent heat of 220 BTU's per pound causes vaporization and expansion to occur. If the liquid natural gas is confined during the application of heat to the liquid natural gas, then this reaction will provide the requisite 5000 psig for CNG storage. LNG weighs about 55 percent less than water. LNG is odorless, colorless, non-corrosive, and non-toxic. When vaporized, it burns only in concentrations of 5 percent to 15 percent when mixed with air. Neither LNG, nor its vapor can explode in an unconfined environment.

In the United States, the Department of Transportation (DOT) regulates the transportation of LNG as well as the drivers of the trucks. The double-walled trucks are like "thermos-bottles" on wheels. They transport LNG at minus 250 degrees F. LNG can be stored up to three days in the tanks of the trucks without losing any LNG through the boil-off process. The inner tanks of the trucks are made of thick aluminum designed to withstand up to 100 pounds of pressure. There is a steel outer shell around the outside of the inner tank. The tanks are designed to withstand most accidents that may occur during the transportation of LNG.

During the years of controlled testing by independent laboratories and hundreds of thousands of gallons (intentional) spilled LNG, ignition of a vapor cloud has yet to cause an explosion. In fact, some testing involved initiating the combustion of the gas cloud with high explosives. The strength of the detonation was no stronger than that delivered by the explosives. Thus, the ignition of LNG or LNG vapor will not cause an explosion in an unconfined environment. Natural gas is only combustible at a concentration of 5 to 15 percent when mixed with air. And, its flame speed is very slow.

Currently, there are approximately 39 satellite and approximately 55 liquefaction facilities in the United States. In other countries, there are approximately 81 satellite and approximately 14 liquefaction facilities. Since deregulation of the natural gas industry, the construction of LNG facilities in the United States has increased.

There exists a need for new modular technology to provide clean and accessible fuel for remote compressed natural gas supply by liquefied natural gas trucking that does not rely upon complicated and maintenance intensive systems. Most conventional natural gas handling systems today rely upon compressors and pumps to move and/or convert the liquefied natural gas to compressed natural gas.

In view of the above, there exists a need for a natural gas handling system which overcomes the above mentioned problems in the prior art. This invention addresses this need in the prior art as well as other needs, which will become apparent to those skilled in the art from this disclosure.

SUMMARY OF THE INVENTION

An object of the present invention is to provide a new modular natural gas handling system to provide clean and accessible fuel for remote compressed natural gas supplied by liquefied natural gas trucking.

Another object of the present invention is to provide a natural gas handling system that does not rely on complicated systems.

Another object of the present invention is to provide a natural gas handling system for converting liquid natural gas to compressed natural gas that does not require maintenance intensive systems.

Another object of the present invention is to provide a natural gas handling system that provides cooling source using the latent heat and sensible heat as a source for refrigeration.

The foregoing objects can basically be attained by a method of handling natural gas comprising the steps of cooling a storage unit by supplying liquefied natural gas thereto; removing low pressure natural gas vapor from the storage unit; supplying liquefied natural gas to the storage unit to a predetermined level within the storage unit; and heating the storage unit to convert the liquefied natural gas within the storage unit to compressed natural gas of a predetermined pressure; and supplying the compressed natural gas at the predetermined pressure to a compressed natural gas unit.

The foregoing objects can also be attained by providing a natural gas handling system comprising a LNG/CNG storage unit having a predetermined capacity and a predetermined pressure rating, the LNG/CNG storage unit having an inlet line with a first on/off valve to selectively receive liquefied natural gas, a first outlet line with a second on/off valve to selectively deliver low pressure natural gas, and a second outlet line with a third valve to selectively deliver compressed natural gas; a first heat exchanger operatively coupled to the storage unit to heat liquefied natural gas contained within the storage unit; a level detection indicator operatively coupled to the storage unit to indicate a predetermined level of liquefied natural gas contained within the storage unit; a first pressure regulator coupled to the first outlet to allow natural gas vapor to be removed from the storage unit upon reaching a first predetermined pressure; and controls operatively coupled to the first and second on/off valves to selectively open the first and second on/off valves during filling of the storage unit, and to selectively close the first and second on/off valve when the liquefied natural gas in the storage unit reaches the predetermined level as indicated by the level detection indicator.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
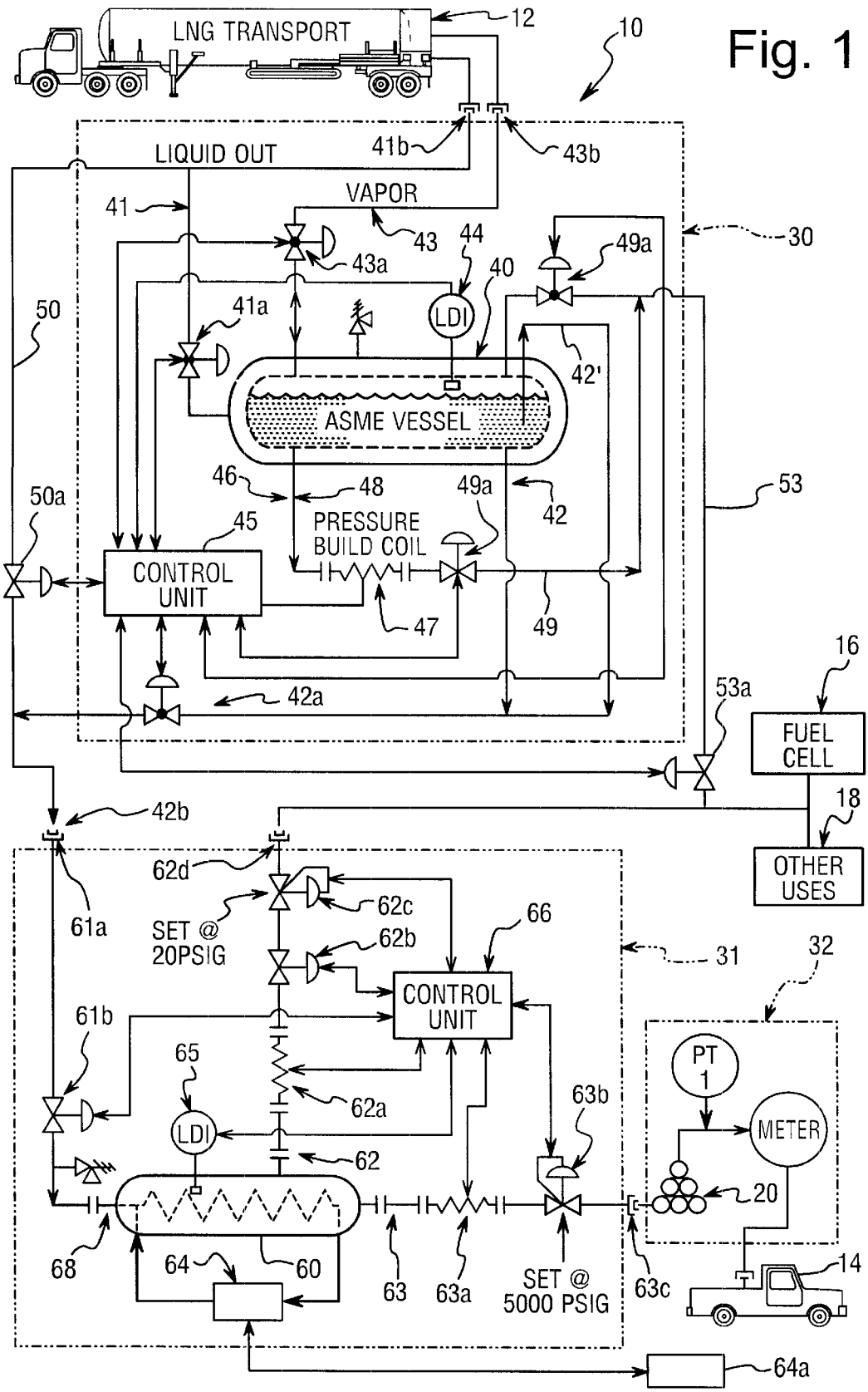
FIG. 1 is a schematic illustration of a natural gas handling system in accordance with the present invention.

Referring initially to FIG. 1, a natural gas handling system 10 is schematically illustrated in accordance with the present invention. The natural gas handling system 10 is preferably part of a natural gas fueling station that is designed to receive liquefied natural gas (LNG) from an LNG transport vehicle 12, and then dispense natural gas (CNG) to a natural gas operated vehicle 14. Moreover, the natural gas handling system 10 is also utilized to provide low pressure natural gas to various devices such as a fuel cell or natural gas generator 16 for producing electricity and/or other natural gas operated devices 18. The natural gas handling system 10 can be used as a source of refrigeration during the vaporization process of LNG. The natural gas handling system 10 can also be coupled to a CNG deinventory system.

The natural gas handling system 10 basically includes a LNG storage and transfer component 30, a LNG to CNG (LNG/CNG) conversion component 31, a low pressure natural gas component 32, and a compressed natural gas (CNG) storage and dispensing component 33. Preferably, the LNG/CNG conversion component 31 is a portable and modular unit that can be easily coupled to the components 30, 32 and 33. In other words, the LNG/CNG conversion component 31 is preferably a modular and portable unit that is pre-manufactured for use with a LNG/CNG fueling station that includes a LNG storage tank and a CNG storage tank. For example, the LNG/CNG conversion component 31 can have a length of 40 feet, a width of 12 feet and a height of 10 feet. The LNG storage and transfer component 30, the low pressure natural gas component 32 and the compressed natural gas storage and dispensing component 33 are preferably components that are part of a LNG/CNG fueling station.

The components 30, 31, 32 and 33 of the natural gas handling system 10 are preferably controlled by a supervisory control and data acquisition (SCADA) system that uses programmable logic controllers (PLC) and/or remote terminal units (RTU). In other words, the control units 45 and 66, discussed below, use programmable logic controllers (PLC) and/or remote terminal units (RTU). Programmable logic controllers (PLC) and remote terminal units (RTU) are well known in the art. Thus, it will be apparent to those skilled in this field from this disclosure that known programmable logic controllers (PLC) and/or remote terminal units (RTU) can be implemented to carry out the functions of the control units 45 and 66, discussed below. For this reason, the precise arrangement of programmable logic controllers (PLC) and/or remote terminal units (RTU) of the control units 45 and 66 will not be discussed and/or illustrated herein.

The CNG storage and dispensing component 33 utilize a standard pyramid configuration of 50 MSCF of pressurized CNG storage tanks 20. Since the CNG storage and dispensing component 33 is relatively conventional. Thus, the CNG storage and dispensing component 33 will only be diagrammatically illustrated The LNG storage and transfer component 30 basically includes a storage tank 40 having a LNG inlet line 41 with an on/off inlet control valve 41*a*, an LNG outlet line 42 with an on/off control valve 42*a*, a vapor outlet line 43 with an on/off outlet control valve 43*a*, and a liquid detection indicator 44. The LNG storage and transfer component 30 is designed to receive LNG from transport vehicle 12 by coupling LNG inlet line 41 and vapor outlet line 43 to the transport vehicle 12 in a conventional manner. Normally, the LNG is stored at minus 260° F. within the tank of the transport vehicle 12. Normally, the pressure from the transport vehicle 12 does not have enough pressure to supply pressurized LNG to the storage tank 40. Thus, an electrical pump can be utilized to move the LNG from the transport truck to the storage tank 40. Alternatively, the LNG storage and transfer component 30 can be utilized to assist in transferring the LNG from the transport vehicle 12 to the storage tank 40.

The storage tank 40 is preferably provided with a cryogenic pump 46 to assist in the transfer, of liquid natural gas from the transport vehicle 12 to tank 40. The cryogenic pump 46 basically includes a pressure build coil or heat exchanger 47 having an inlet line 48 coupled to the bottom of storage tank 40 and an outlet line 49 coupled to the top of the storage tank 40. A pressure regulator or regulating valve 49*a* and an on/off control valve 49*b* are located within outlet line 49 for controlling the pressurization of the storage tank 40 as discussed below.

Preferably, the storage tank 40 is preferably a LNG storage tank having a predetermined capacity of approximately 3000 gallons of LNG storage and a predetermined pressure rating of at least 150 psig. The LNG is normally stored in the storage tank 40 at −260° F. and at 40 psig. The storage tank 40 is preferably a relatively conventional storage tank with bottom penetrations for allowing gravity feed pressure build of the storage tank 40, and for gravity feed to the LNG/CNG conversion component 31. Of course, it will be apparent to those skilled in the art from this disclosure that the natural gas handling system 10 can be modified such that storage tank 10 does not have a bottom penetration, as seen in a later embodiment.

A bypass line 50 is coupled to the LNG inlet line 41 for directly transferring the LNG from the transport vehicle 12 to the LNG/CNG conversion component 31. An on/off control valve 50*a* is located in the bypass line 50 to control the flow of the LNG to the LNG/CNG conversion component 31. The control valve 50*a* is a conventional valve that can be either manually operated or automatically operated by a control unit 45. Since on/off control valves such as control valve 50*a* are well known in the art, the control valve 50*a* will not be discussed and/or illustrated herein. The control valve 50*a* can be a solenoid valve that is spring biased to a closed position. Alternatively, the pressure of the natural gas can operate the control valve 50*a*, instead of electricity. As explained below, the bypass line 50 is used at the beginning of a cycle for converting the LNG to CNG.

The LNG inlet line 41 is preferably provided with a conventional or standard coupling 41*b* at its inlet end for connecting to the outlet of the transport vehicle 12 for transferring the LNG from the transport vehicle 12 to the storage tank 40. The on/off control valve 41*a* is a conventional valve that can be either manually operated or automatically operated by a control unit 45. Since on/off control valves such as control valve 41*a* are well known in the art, the control valve 41*a* will not be discussed and/or illustrated herein. The control valve 41*a* can be a solenoid valve that is spring biased to a closed position. Alternatively, the pressure of the natural gas can operate the control valve 41*a*, instead of electricity. Liquid natural gas is preferably either gravity fed to the storage unit 40 through LNG inlet line 41, or alternatively, a pressure build coil is utilized for pressurizing the tank of the transport vehicle 12 such that the LNG is pumped out of the transport vehicle 12 without any pumps.

The LNG outlet line 42 is coupled to the bottom of the storage tank 40 with the on/off control valve 42*a* for controlling the transfer of the LNG to the LNG/CNG conversion component 31. The on/off control valve 42*a* is a conventional valve that can be either manually operated or automatically operated by the control unit 45. Alternatively, the storage tank 40 can have a LNG outlet line 42' is coupled between the top of the storage tank 40 aid the on/off control valve 42*a* for controlling the transfer of the LNG to the LNG/CNG conversion component 31. Since on/off control valves such as control valve 42*a* are well known in the art, the control valve 42*a* will not be discussed and/or illustrated herein. The control valve 42*a* can be a solenoid valve that is spring biased to a closed position. Alternatively, the pressure of the natural gas can operate the control valve 42*a*, instead of electricity.

The LNG outlet line 42 or 42' is preferably provided with a conventional or standard coupling 42*b* at its outlet end for connecting to the LNG/CNG conversion component 31, as discussed below. Alternatively, the LNG/CNG conversion component 31 can be permanently coupled to the LNG storage and transfer component 30. If the LNG/CNG conversion component 31 is permanently connected to the LNG storage and transfer component 30, then the coupling 42*b* can be eliminated, as will become apparent from the discussion below pertaining to the LNG/CNG conversion component 31.

The LNG vapor outlet line 43 is preferably provided with a conventional or standard coupling 43*b* at its outlet end for connecting to a corresponding coupling of the transport vehicle 12 for adding pressure to the LNG tank of the transport vehicle 12. The on/off control valve 43*a* is a conventional valve that can be either manually operated or automatically operated by the control unit 45. Since on/off control valves, such as control valve 43*a*, are well known in the art, the control valve 43*a* will not be discussed and/or illustrated in detail herein. The control valve 43*a* can be a solenoid valve that is spring biased to a closed position. Alternatively, the pressure of the natural gas can operate the control valve 43*a*, instead of electricity.

The level detection indicator 44 is preferably a conventional device that is well known in the art. Thus, the level detection indicator 44 will not be discussed and/or illustrated in detail herein. The level detection indicator 44 can be coupled to a control unit 45 for automatically controlling the various valves of component 30. The level detection indicator 44 indicates the level of LNG within the storage tank 40. Preferably, when the level detection indicator 44 indicates that the storage tank 40 has been filled to a predetermined level, this will cause control valves 41*a*, 43*a* and 49*b* to be closed. Thus, the LNG located within the storage tank 40 is now isolated. The control unit 45 can then be utilized to transfer the LNG from LNG storage and transfer component 30 to the LNG/CNG conversion component 31.

The pressure build coil or heat exchanger 47 is preferably a conventional gravity fed pressure build coil or heat exchanger that utilizes ambient air to warm the LNG. The warmed LNG increases in pressure to at least 50 psig within the pressure build coil 47. Once the LNG in the pressure build coil 47 reaches at least 50 psig, the LNG is transferred back to the storage tank 40 to pressurize the storage tank 40. More specifically, the pressure regulator 49*a* is a pressure relief valve that is set at approximately 50 psig such that once the pressure in the pressure build coil 47 reaches 50 psig, the LNG can pass through the outlet line 49 back into the storage tank 40. As mentioned above, the outlet line 49 has an on/off control valve 49*b*, which can be closed to isolate the storage tank 40 from the pressure build coil 47. Preferably, the on/off control valve 49*a* is controlled by the control unit 45. Of course, it will be apparent to those skilled in the art from this disclosure that the control valve 49*a* can be manually operated. This increased pressure in the storage tank 40 will provide the force to move the LNG from LNG storage and transfer component 30 to the LNG/CNG conversion component 31.

The LNG/CNG conversion component 31 is designed to convert the liquefied natural gas to compressed natural gas. In other words, the liquefied natural gas having a pressure of approximately 60 psig is delivered to the LNG/CNG conversion component 31. The LNG/CNG conversion component 31 then converts the LNG to compressed natural gas (CNG) having a pressure of approximately 5000 psig.

Basically, the LNG/CNG conversion component 31 includes a storage unit or tank 60 having an inlet line 61, a first outlet line 62, a second outlet line 63 and a heat exchanger or pressure build coil 64. The storage tank 60 is also provided with a level detection indicator 65 that is operatively coupled to storage tank 60 to indicate the level of liquid natural gas contained within the storage tank 60. Preferably, the storage tank 60 has a predetermined capacity of 1000 gallons and a predetermined pressure rating of approximately 5000 psig. Initially, the storage tank 60 receives a small amount of LNG from the storage tank 40 via the bypass line 50 and inlet line 61. This small amount of LNG is used to initially cool down the temperature of the storage tank 60. Alternately, a water/glycol based fluid can be initially used in the heat exchanger 64 to remove the heat from the storage tank 60. Thus, the water/glycol based fluid would be cooled down such that it can be used as a cooling source (refrigerant) for use with an onsite unit 64*a*. In other words, the onsite unit 64*a* has a cooling section that is cooled by the water/glycol based fluid that was cooled down by the heat exchanger 64.

Pressure regulator 62*c* will immediately begin to relieve vapor to the fuel cell 16 or the other devices 18, as explained below. The fuel cell 16 or the other devices 18 can also receive the LNG that has been warmed to 60 psig vapor from line 53, which is coupled to the outlet line 49. The line 53 has an on/off control valve 53*a* that can be either manually operated or automatically operated by the control unit 45. Since on/off control valves, such as control valve 53*a*, are well known in the art, the control valve 53*a* will not be discussed and/or illustrated in detail herein. The control valve 53*a* can be a solenoid valve that is spring biased to a closed position. Alternatively, the pressure of the natural gas can operate the control valve 53*a*, instead of electricity.

After cool-down, the liquefied natural gas LNG will fill storage tank 60 to 90 percent of its volume. Twelve gallons of LNG are required for each MSCF of vapor. As explained below, as the heat of vaporization is applied to the LNG in storage tank 60, the LNG will boil off and the pressure in the storage tank 60 will rise. The back pressure from the storage tank 60 will be allowed to charge the CNG storage tanks 20 until the vapor flow stops as pressure equalization occurs. The second outlet line 63 is a 5000 psig line that runs to the compressed natural gas storage and dispensing component 33.

At the end of each cycle, the path to the storage tank 60 is isolated and the vapor is allowed to flow to the CNG deinventory component until the pressure in the vessel reaches the 20 psig. After the system is de-energized to 20 psig, another cycle can begin. Thus, before each cycle of converting LNG to CNG, the storage tank 60 preferably has a pressure of approximately 20 psig.

The inlet line 60 preferably has a first end with a coupling 61*a* that is adapted to be releasably coupled to outlet coupling 42*b* of the outlet line 42 of the storage tank 40. The inlet line 61 also includes an on/off control valve 61*b* located between the coupling 61*a* and the storage tank 60. The on/off control valve 61*b* is preferably an automatically controlled valve controlled by a control unit 66. Alternatively, a manual valve could be utilized for the control valve 61*b*. The control valve 61*b* can be a solenoid valve that is spring biased to a closed position. Alternatively, the pressure of the natural gas can operate the control valve 61*b*, instead of electricity.

The first outlet line 62 preferably includes a heat exchanger 62*a*, an on/off control valve 62*b* and a pressure regulator 62*c*. The heat exchanger 62*a* is preferably a conventional heat exchanger that utilizes ambient air or warm air for preheating the low pressure natural gas being siphoned off of the storage tank 60. The precise construction of the heat exchanger 62*a* is not relevant to the present invention. Any conventional heat exchanger can be utilized as needed and/or desired.

The on/off control valve 62*b* is preferably a conventional valve that is automatically controlled by the control unit 66. The control valve 62*b* can be a solenoid valve that is spring biased to a closed position. Alternatively, the pressure of the natural gas can operate the control valve 62*b*, instead of electricity. The control valve 62*b* is utilized to isolate or otherwise stop the flow of vapor from being removed from the storage tank 60 through the first outlet line 62. Normally, the control valve 62*b* is operated substantially simultaneously with the control valve 61*b*. Thus, the control valves 61*b* and 62*b* act to isolate the storage tank 60 so that pressure can be built up to approximately 5000 psig in the storage tank 60 as explained below.

The pressure regulator 62*c* is preferably a conventional pressure regulator or pressure relief valve that is set at approximately 20 psig. Thus, when the control valve 62*b* is open, the pressure regulator 62*c* allows natural gas vapor to be removed from the storage tank 60 when the vapor reaches at least approximately 20 psig. Of course, when the control valve 62*b* is closed, this renders the pressure regulator 62*c* inoperative. During the cool down of the storage tank 60, the first outlet line 62 and pressure regulator 62*c* allows the vapor from the LNG to be siphoned off and used to operate other devices such as devices 16 and 18. Also, the first outlet line 62 and the pressure regulator 62*c* allows the storage tank 60 to be filled to 90% with LNG by venting the vapor in the storage tank 60.

The free end of the outlet line 62 is preferably provided with a standard coupling 62*d* for coupling the outlet line 62 to a transfer line connected to the fuel cell or generator 16 and/or the other devices 18. Thus, the outlet line 62 is utilized for supplying low pressure natural gas vapor to devices in the natural gas fueling station, as needed and/or desired. This is an important aspect since it allows the storage tank 60 to be filled up to approximately 90% of its capacity, and then to be pressurized to 5000 psig.

Once the storage tank 60 is filled up to approximately 90% of its capacity, the LNG is heated by ambient air and/or a remote source through the heat exchanger 64. As previously mentioned, a water/glycol based fluid can be fed through the heat exchanger 64 to heat the LNG in the storage tank 60 by cooling down the water/glycol based fluid. Depending upon the desired final temperature of the LNG, it may be necessary to switch from the water/glycol based fluid to ambient air or warmed art to obtain the desired final temperature of the LNG. Thus, the LNG is preferably heated from −260° F. to 40° F. As the heat of vaporization is applied to the LNG in storage tank 60, the LNG will boil off and the pressure in the storage tank 60 will rise. Thus, the pressure of the LNG will increase from 40 psig to 5000 psig. The back pressure from the storage tank 60 will be allowed to charge the CNG storage tanks 20 until the vapor flow stops as pressure equalization occurs. The second outlet line 63 is a 5000 psig line that runs to the compressed natural gas storage and dispensing component 33.

The outlet line 63 transfers compressed natural gas at 5000 psig to the CNG storage tanks 20. More specifically, the outlet line 63 includes a heat exchanger 63*a*, a pressure regulator 63*b* and a standard coupling 63*c* at its free end. The heat exchanger 63*a* is designed to preheat the compressed natural gas utilizing either ambient air or an active heater. Thus, warm 5000 psig natural gas is supplied to the storage tanks 20.

When the liquid level in storage unit 60 drops to 10%, the cycle will be repeated for continuously providing warm natural gas for power generation and other on-sight or off-sight uses as well.

The terms of degree such as "substantially", "about" and "approximately" as used herein mean a reasonable amount of deviation of the modified term such that the end result is not significantly changed. These terms should be construed as including a deviation of at least ±5% of the modified term if this deviation would not negate the meaning of the word it modifies.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A method of handling natural gas comprising the steps of:

cooling a storage unit by supplying liquefied natural gas thereto;

removing low pressure natural gas vapor from said storage unit when pressure within said storage unit reaches a first predetermined pressure;

supplying liquefied natural gas to said storage unit to a predetermined level within said storage unit at a second predetermined pressure;

isolating said storage unit to form an isolated chamber that prevents further natural gas from exiting said storage unit;

heating said storage unit while said storage unit is isolated to convert said liquefied natural gas within said storage unit to compressed natural gas of a third predetermined pressure that is greater than twice said first and second predetermined pressures; and supplying said compressed natural gas at said third predetermined pressure to a compressed natural gas unit.

2. The method of handling natural gas according to claim 1, wherein said predetermined level is approximately ninety percent of capacity of said storage unit.

3. The method of handling natural gas according to claim 1, wherein said predetermined pressure of said compressed natural gas is approximately 5000 psig.

4. The method of handling natural gas according to claim 1, further comprising heating said low pressure natural gas vapor that is being removed from said storage tank.

5. The method of handling natural gas according to claim 4, further comprising supplying said low pressure natural gas vapor to a low pressure natural gas unit.

6. The method of handling natural gas according to claim 5, further comprising regulating said low pressure natural gas vapor to a predetermined pressure level.

7. The method of handling natural gas according to claim 6, wherein said predetermined pressure level of said low pressure natural gas vapor is regulated to supply 20 psig to said low pressure natural gas unit.

8. A method of handling natural gas comprising the steps of:

cooling a storage unit located at a site location by supplying liquefied natural gas thereto;

removing low pressure natural gas vapor from said storage unit;

supplying liquefied natural gas to said storage unit to a predetermined level within said storage unit; and heating said storage unit to convert said liquefied natural gas within said storage unit to compressed natural gas of a predetermined pressure;

supplying said compressed natural gas at said predetermined pressure to a compressed natural gas unit; and using a fluid to perform said heating of said storage unit, and then using said fluid as a cooling source for use with an onsite unit at said site location.

9. A method of handling natural gas comprising the steps of:

cooling a storage unit by supplying liquefied natural gas thereto;

removing low pressure natural gas vapor from said storage unit;

supplying liquefied natural gas to said storage unit to a predetermined level within said storage unit;

heating said storage unit to convert said liquefied natural gas within said storage unit to compressed natural gas of a predetermined pressure; and supplying said compressed natural gas at said predetermined pressure to at least one compressed natural gas storage tank to maintain said predetermined pressure of said compressed natural gas.

10. A natural gas handling system comprising:

a LNG/CNG storage unit having a predetermined capacity and a predetermined pressure rating, said LNG/CNG storage unit having a liquefied natural gas inlet line with a first on/off valve configured to selectively receive liquefied natural gas, a first outlet line with a second on/off valve configured to selectively deliver low pressure natural gas, and a second outlet line with a third valve configured to selectively deliver compressed natural gas;

a first heat exchanger operatively coupled to said storage unit and arranged to heat liquefied natural gas contained within said storage unit when said first and second on/off valves are closed;

a level detection indicator operatively coupled to said storage unit to indicate a predetermined level of liquefied natural gas contained within said storage unit;

a first low pressure regulator coupled to said first outlet line and set to allow natural gas vapor to exit from said storage unit upon reaching a first predetermined pressure when said second on/off valve is open; and controls operatively coupled and configured to said first and second on/off valves to selectively open said first and second on/off valves during filling of said storage unit through said liquefied natural gas inlet line, and to selectively close both of said first and second on/off valves when said liquefied natural gas in said storage unit reaches said predetermined level as indicated by said level detection indicator, said second on/off valve being located in said first outlet line to prevent natural gas from exiting said storage unit when said second on/off valve is closed and natural gas in said storage unit is above said first predetermined pressure.

11. The natural gas handling system according to claim 10, wherein said third valve is a second pressure regulator coupled to said second outlet to allow compressed natural gas to be removed from said storage unit upon reaching a second predetermined pressure.

12. The natural gas handling system according to claim 11, wherein said second predetermined pressure of said second pressure regulator is set at approximately 5000 psig.

13. The natural gas handling system according to claim 10, wherein said third valve is an on/off valve.

14. The natural gas handling system according to claim 10, further comprising a LNG storage tank being coupled to said inlet line.

15. The natural gas handling system according to claim 14, wherein said LNG storage tank includes an inlet line, an outlet line, a vapor outlet line and a pressure build coil.

16. The natural gas handling system according to claim 10, wherein said first heat exchanger is coupled to a unit which uses fluid from said first heat exchanger as a cooling source.

17. A natural gas handling system comprising:

a LNG/CNG storage unit having a predetermined capacity and a predetermined pressure rating, said LNG/CNG storage unit having an inlet line with a first on/off valve to selectively receive liquefied natural gas, a first outlet line with a second on/off valve to selectively deliver low pressure natural gas, and a second outlet line with a third valve to selectively deliver compressed natural gas;

a first heat exchanger operatively coupled to said storage unit to heat liquefied natural gas contained within said storage unit;

a level detection indicator operatively coupled to said storage unit to indicate a predetermined level of liquefied natural gas contained within said storage unit;

a first pressure regulator coupled to said first outlet line to allow natural gas vapor to be removed from said storage unit upon reaching a first predetermined pressure;

controls operatively coupled to said first and second on/off valves to selectively open said first and second on/off valves during filling of said storage unit, and to selectively close said first and second on/off valve when said liquefied natural gas in said storage unit reaches said predetermined level as indicated by said level detection indicator; and at least one compressed natural gas tank being coupled to said second outlet line.

18. A natural gas handling system comprising:

a LNG/CNG storage unit having a predetermined capacity and a predetermined pressure rating, said LNG/CNG storage unit having an inlet line with a first on/off valve to selectively receive liquefied natural gas, a first outlet line with a second on/off valve to selectively deliver low pressure natural gas, and a second outlet line with a third valve to selectively deliver compressed natural gas;

a first heat exchanger operatively coupled to said storage unit to heat liquefied natural gas contained within said storage unit;

a level detection indicator operatively coupled to said storage unit to indicate a predetermined level of liquefied natural gas contained within said storage unit;

a first pressure regulator coupled to said first outlet line to allow natural gas vapor to be removed from said storage unit upon reaching a first predetermined pressure;

controls operatively coupled to said first and second on/off valves to selectively open said first and second on/off valves during filling of said storage unit, and to selectively close said first and second on/off valve when said liquefied natural gas in said storage unit reaches said predetermined level as indicated by said level detection indicator; and a second heat exchanger being operatively coupled to said first outlet line.

19. A natural gas handling system comprising:

a LNG/CNG storage unit having a predetermined capacity and a predetermined pressure rating, said LNG/CNG storage unit having an inlet line with a first on/off valve to selectively receive liquefied natural gas, a first outlet line with a second on/off valve to selectively deliver low pressure natural gas, and a second outlet line with a third valve to selectively deliver compressed natural gas;

a first heat exchanger operatively coupled to said storage unit to heat liquefied natural gas contained within said storage unit;

a level detection indicator operatively coupled to said storage unit to indicate a predetermined level of liquefied natural gas contained within said storage unit;

a first pressure regulator coupled to said first outlet line to allow natural gas vapor to be removed from said storage unit upon reaching a first predetermined pressure;

controls operatively coupled to said first and second on/off valves to selectively open said first and second on/off valves during filling of said storage unit, and to selectively close said first and second on/off valve when said liquefied natural gas in said storage unit reaches said predetermined level as indicated by said level detection indicator; and a second heat exchanger being operatively coupled to said second outlet line.

20. A natural gas handling system comprising:

a LNG/CNG storage unit having a predetermined capacity and a predetermined pressure rating, said LNG/CNG storage unit having an inlet line with a first on/off valve to selectively receive liquefied natural gas, a first outlet line with a second on/off valve to selectively deliver low pressure natural gas, and a second outlet line with a third valve to selectively deliver compressed natural gas;

a first heat exchanger operatively coupled to said storage unit to heat liquefied natural gas contained within said storage unit;

a level detection indicator operatively coupled to said storage unit to indicate a predetermined level of liquefied natural gas contained within said storage unit;

a first pressure regulator coupled to said first outlet line to allow natural gas vapor to be removed from said storage unit upon reaching a first predetermined pressure;

controls operatively coupled to said first and second on/off valves to selectively open said first and second on/off valves during filling of said storage unit, and to selectively close said first and second on/off valve when said liquefied natural gas in said storage unit reaches said predetermined level as indicated by said level detection indicator; and additional heat exchangers being operatively coupled to said first and second outlet lines.

* * * * *